United States Patent [19]

Johansson et al.

[11] 4,205,469

[45] Jun. 3, 1980

[54] CUTTER TOOTH SYSTEM

[75] Inventors: Arne Johansson; Torsten Larsson, both of Karlskoga, Sweden

[73] Assignee: Aktiebolaget Bofors, Bofors, Sweden

[21] Appl. No.: 939,730

[22] Filed: Sep. 5, 1978

[30] Foreign Application Priority Data

Sep. 6, 1977 [SE] Sweden ..... 7709968

[51] Int. Cl.[2] ..... E02F 9/28

[52] U.S. Cl. ..... 37/142 R

[58] Field of Search ..... 37/141 R, 141 T, 142 R, 37/142 A

[56] References Cited

U.S. PATENT DOCUMENTS 2,220,819 11/1940 Johnson ..... 37/141 R 2,385,395 9/1945 Baer ..... 37/142 A 3,371,437 5/1968 Wilson et al. ..... 37/142 R

FOREIGN PATENT DOCUMENTS 2153964 9/1972 Fed. Rep. of Germany ..... 37/142 R

*Primary Examiner*—E. H. Eickholt

*Attorney, Agent, or Firm*—Pollock, Vande Sande & Priddy

[57] ABSTRACT

A cutter tooth for earth moving machines is attached to an adapter secured to the tool of the machine. A fitting block between the adapter and the tool prevents transverse movement of the adapter and facilitates installation of the tooth at various angles. A resilient securing member secures the tooth to the adapter.

31 Claims, 5 Drawing Figures

CUTTER TOOTH SYSTEM

FIELD OF THE INVENTION

The present invention relates to a cutter tooth system intended for earth-moving machines used for breaking up and disintegrating particularly hard-worked soil, such as unconsolidated rock and coral.

The design of the tooth system has been made especially with consideration to the possibility of giving each and every tooth in one and the same tool, in a simple way, an individual direction adapted to the function of the tool, and not only determined by the design of the tooth-bearing front edge of the tool.

The cutter tooth system according to the invention is primarily contemplated for use for rotating dredge cutters intended for so-called rock dredging, but should also be suitable for use, for example, or bucket wheel dredgers for working of unconsolidated rock.

The type of dredge cutter in mind consists of a plurality of toothed spiral-helical wings, fastened to a central hub and extending rearwardly and outwardly from this hub towards a connecting, rear supporting ring in the feeding direction of the tool. The tool rotates around the above-mentioned hub and on a level with the supporting ring is connected with a suction nozzle through which the bottom soil broken up by the tool is removed. A typical cutter of this kind is described in the U.S. Pat. No. 3.808.716. The details of the design of the cutter are not critical, and will therefore not be dealt with further in this connection.

SUMMARY OF THE INVENTION

The cutter tooth system according to the invention thus comprises an adapter, removably fastened to the tool in question, to which a removably fastened wear part or tooth and means for fastening both the adapter and tooth are attached in their respective places. A characteristic feature of this cutter tooth system is then that the adapter is made in the form of a claw which grips the front edge of the tool and is held in place by a pulling force which is applied between the adapter and a socket fixed to the tool and arranged in line behind the adapter. According to a preferred embodiment, the pulling-securing force is achieved by a bolt running through the socket and the adapter.

In order that the orientation of the adapter shall not be directly dependent on the geometry of the front edge of the tool, the cutter tooth system also comprises a fitting block with an arc-shaped front edge and a rear edge welded to the front edge of the tool. The fitting block will thus constitute a direct extension of the front edge of the tool, but at the same time the fitting block can be adjusted in relation to the working direction of the tool so that the adapter, when installed, gives the tooth the correct position with consideration to the cutting angles it is desired to give the tooth. This is especially important for the previously, briefly described dredge cutters, the spiralhelical wings of which are difficult to manufacture with sufficient precision so that an adapter installed in the way outlined above without any fitting block could give the tooth the direction which gives the best possible cutting angles. The rotating dredge cutter is moreover one of the earth-moving tools for which there are the most stringent requirements as to the way in which the teeth are actually directed.

The fitting block comprised in the invention should preferably be installed at the front edge of the tool with the aid of a removable jig which is used both to set the fitting block and the previously mentioned socket in the correct direction, and to hold these parts in place while they are being welded fast in their correct positions.

As the tooth geometry is very important for dredge cutters of the type in question, in case of local unevenness in the wing of the cutter, it may be necessary to turn the fitting blocks and to set them obliquely in relation to the front edge of the wing.

Even correctly directed teeth are affected by comparatively great side forces, and in order to prevent a displacement of the adapter through turning along the front edge of the fitting block, this fitting block should be given an arced shape, the radius of which differs from the distance between the claw on the adapter and the socket. In principle, this gives two possibilities, firstly that the front edge of the fitting block is given a substantially smaller radius and that the claw has two contact points against the fitting block, which contact points should then be located one on either side of the centre plane of the adpater, and secondly that the front edge of the fitting block has a substantially larger radius.

The transverse forces on a level with the front edge of the adapter can also be absorbed by guide lugs extending upwards in a recess or a groove in the adapter, which are fixed to the fitting block or the front edge of the tools. It is, of course, also possible to mount a guide lug on either side of the adapter.

The transverse forces on a level with the rear end of the adapter can be absorbed by one or a plurality of guide lugs fastened to the tool or the socket.

BRIEF DESCRIPTION OF THE DRAWINGS

The cutter tooth system according to the invention has been defined in the following claims, and will now be described in more detail with reference to the accompanying drawings.

Of these, FIG. 4 shows an enlargement of the part of FIG. 1 which shows the fastening of the teeth, while

DESCRIPTION OF THE PREFERRED EMBODIMENTS

Figure 1:
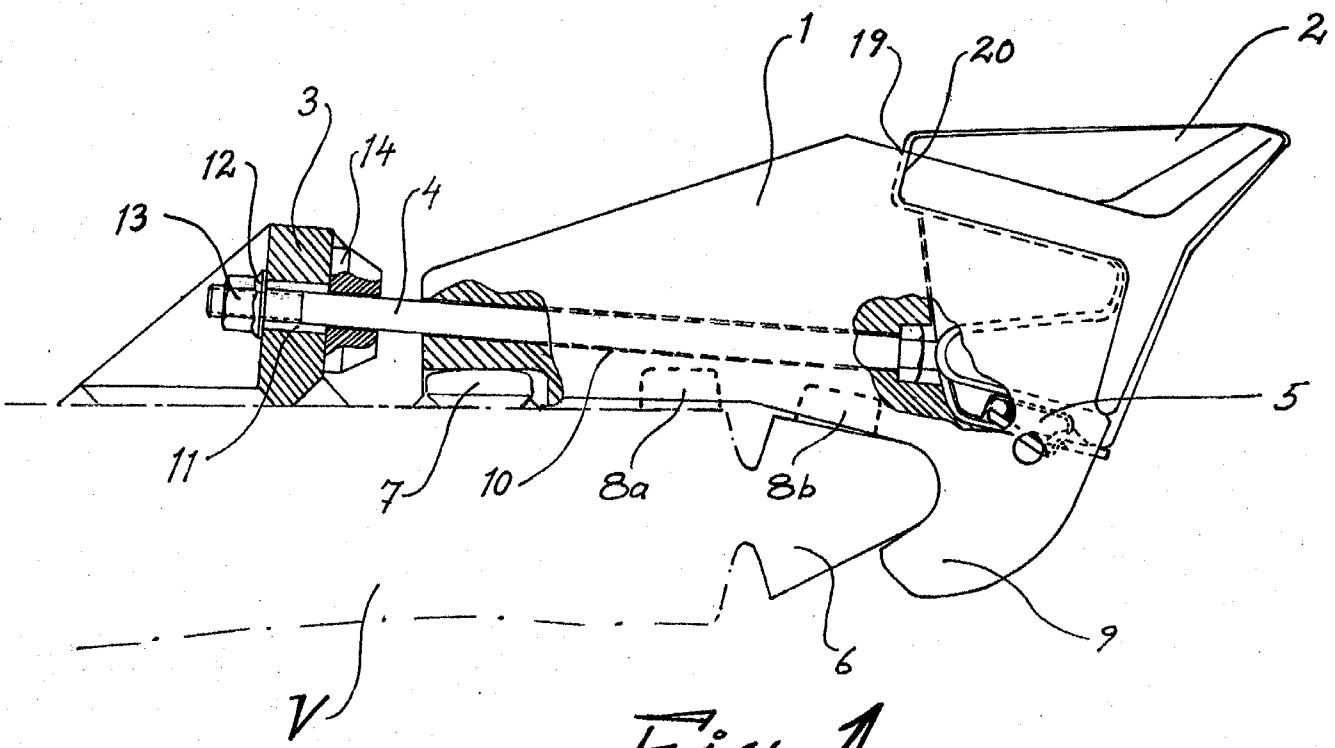
FIG. 1 shows the partly sectioned cutter tooth system according to the invention in a side porjection; while FIGS. 2 and 3 in a plan view show two variants of the cutter tooth system; and finally.

The cutter tooth system according to the invention comprises an adapter 1 and a thereto removably fastened tooth 2, a socket 3 fixed to the tool (in this case the wing of a dredge cutter), a bolt 4 running through the socket and the adapter and joining the two components, a securing member 5 to block the tooth 2 from movement relative to the adapter 1, a fitting block 6 fastened to the front edge of the tool, a guide lug 7 fastened to the tool, and alternative guide lugs 8*a* and 8*b*.

The adapter 1 is made with a claw 9 which grips over the front edge of the fitting block 6 welded to the front edge of the tool. A is provided in hole 10 through the adapter, in which the bolt 4 is supported. From the adapter, the bolt extends through the opening 11 in the socket 3. The bolt is non-rotatably supported in the adapter, and is in contact via a securing washer 12 with a nut 13 with the socket. At the side of the socket facing the adapter there is a welded-on guide bushing 14, which can absorb transverse forces.

Figure 2:
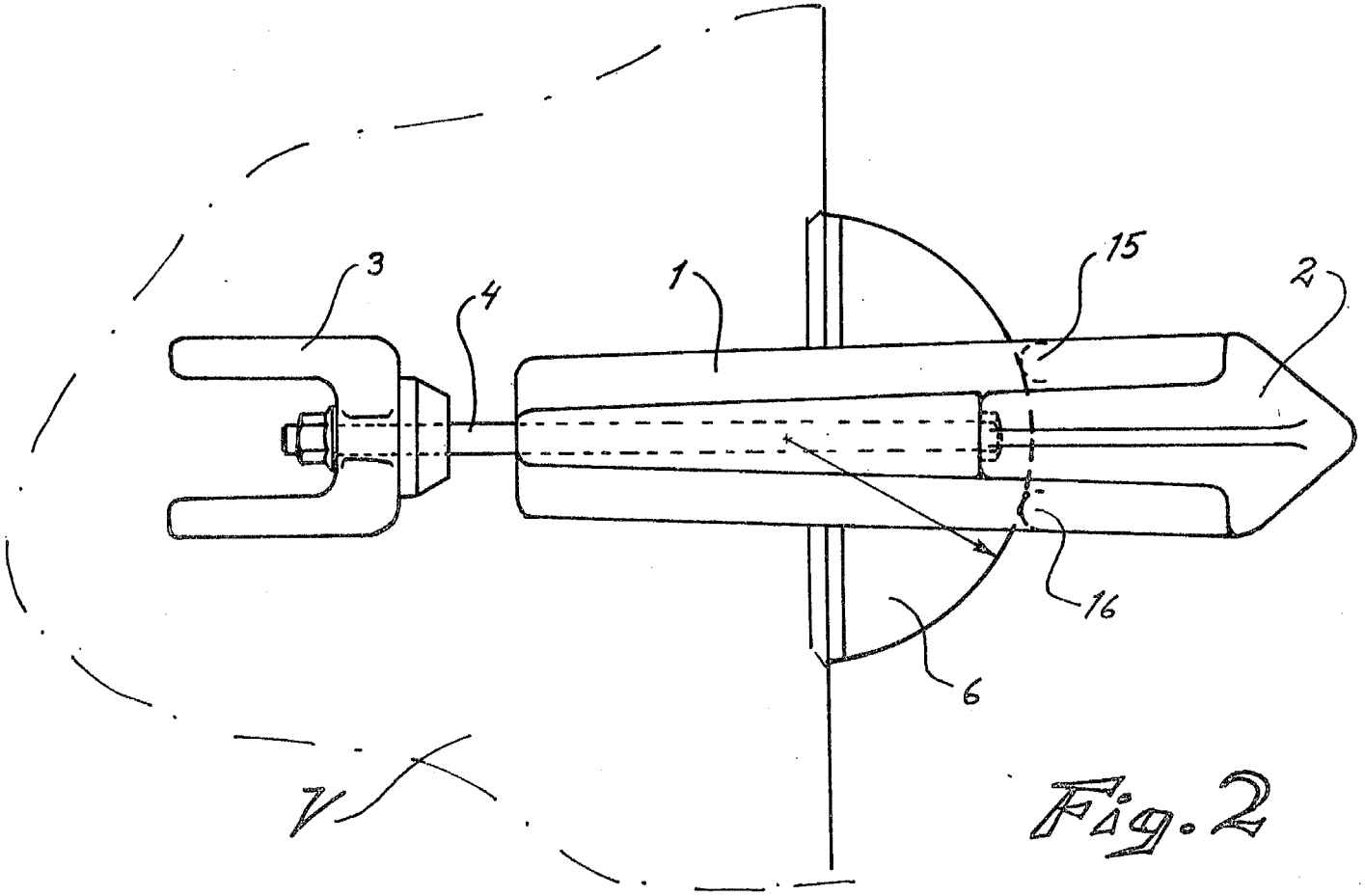
Figure 3:
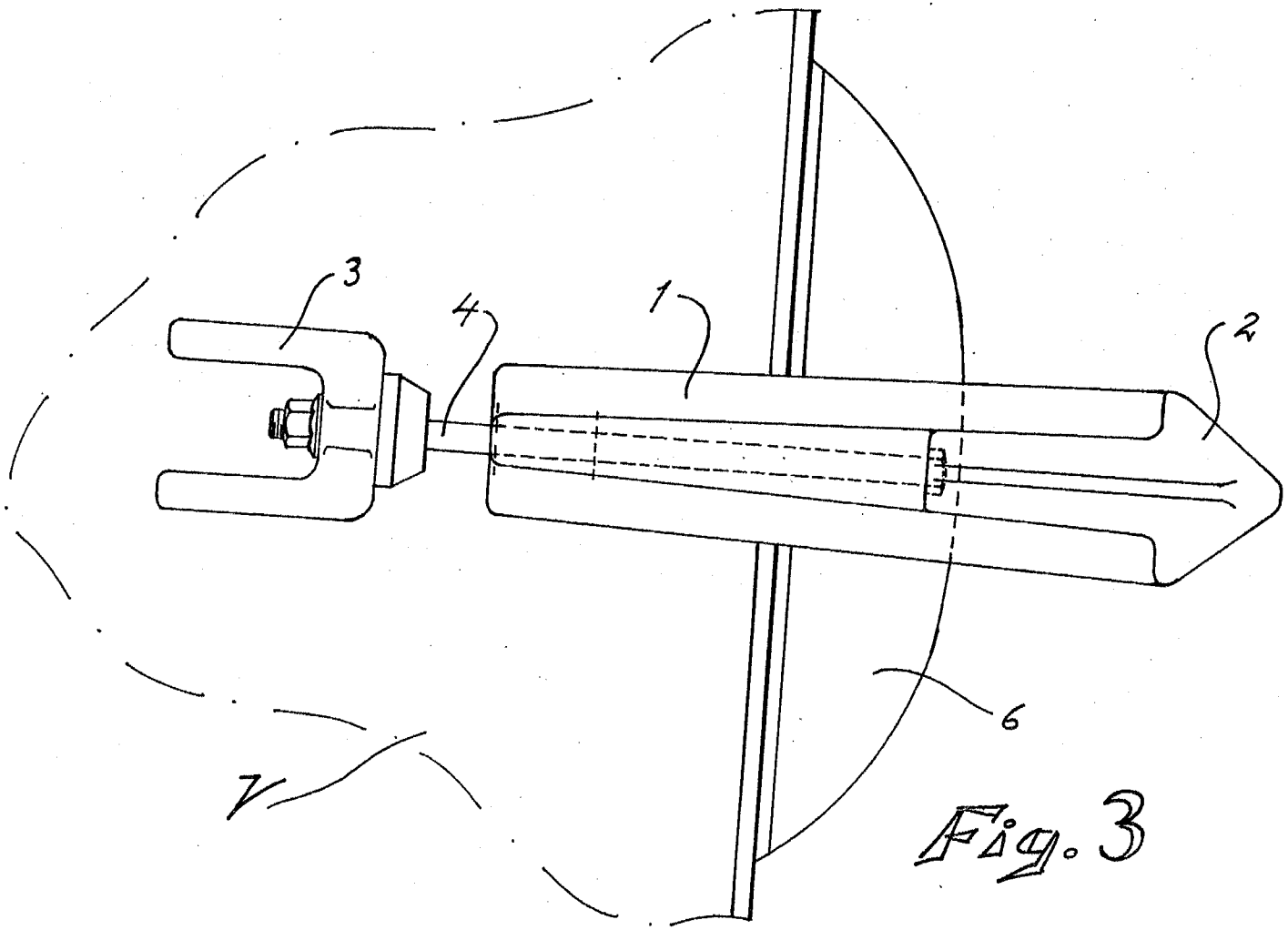

The guide lug 7 welded to the tool and engaging in an opening or groove in the adapter and also the alternative guide lugs 8*a* and 8*b* with corresponding form are also intended to be able to absorb transverse forces. It is also conceivable to provide the socket with a guide lug which goes into a groove in the adapter. FIGS. 2 and 3 show two alternative embodiments of the fitting block 6. According to the variant shown in FIG. 2, the arc-shaped front edge of the fitting block has a substantially smaller radius than the distance between the claw 9 and the support for the bolt 4 in the socket 3. By also having given the claw 9 two contact points 15 and 16, one on each side of the claw, against the fitting block, a non-rotatable fastening of the adapter is thus obtained.

According to the variant shown in FIG. 3, the radius in question is greater than the distance between the claw and the socket, and also in this way a non-rotatable fastening of the adapter is obtained.

Also guide lugs of the alternative type outlined in FIG. 1 and designated 8*a* and 8*b* can be used to prevent rotation.

Figure 4:
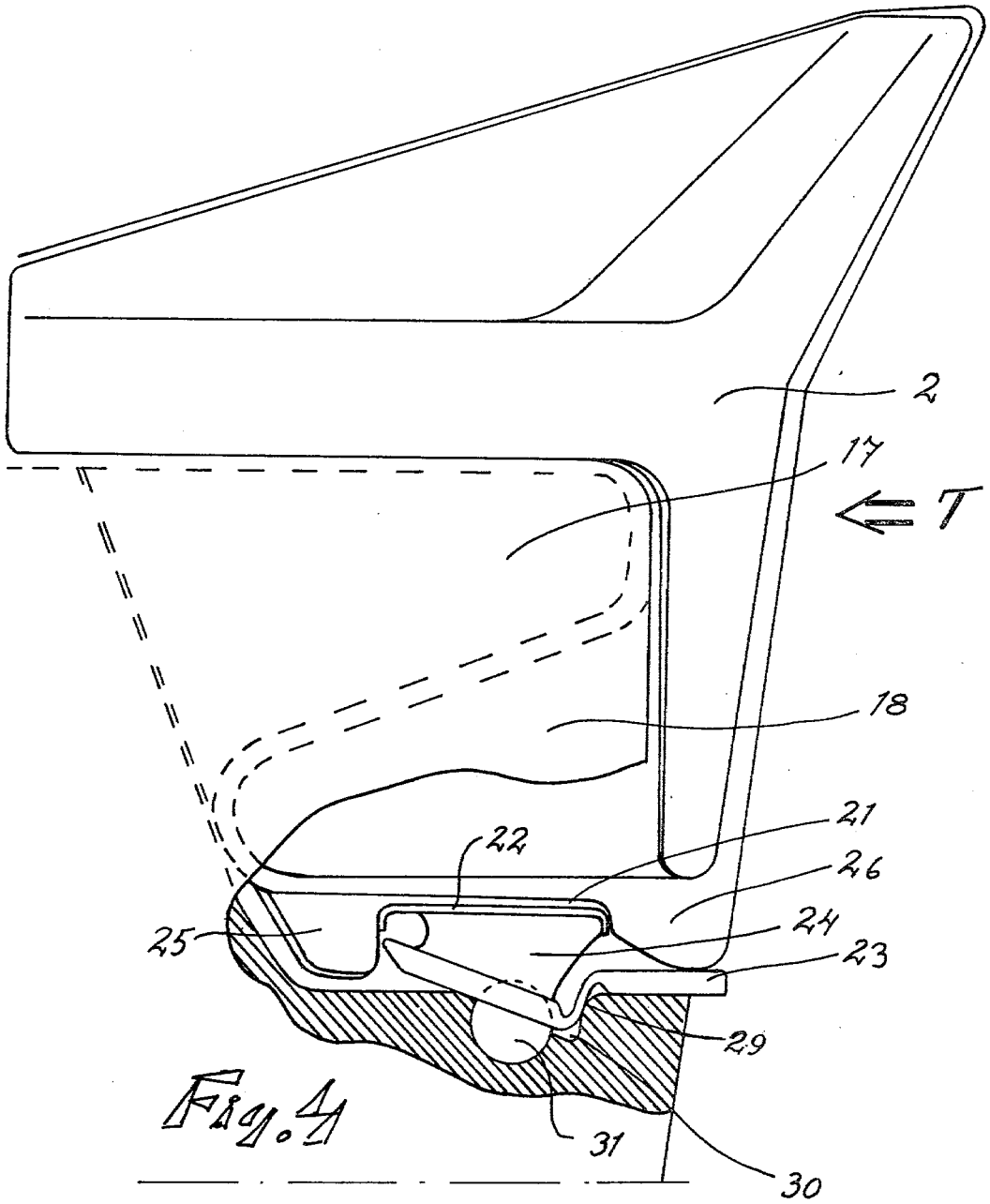
Figure 4A:
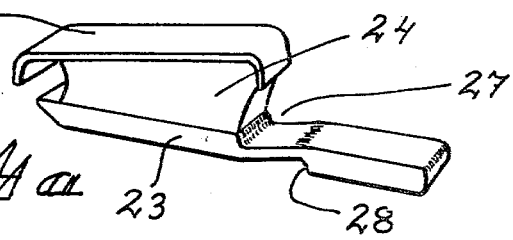
FIG. 4*a* shows only the securing member used, in an oblique projection.

The fastening means for the tooth shown in FIGS. 1 and 4 consist of lands and grooves 17, 18 made in the tooth and the adapter, and coacting with each other. The tooth 2 is inserted in its position in the direction designated by the arrow T. The lands and the grooves and the stopping edges designated 19 and 20 in FIG. 1 coact with each other to determine the position of the tooth in all directions except the direction of installation. In this direction, the tooth is locked in place by a locking wedge 5, comprising two edge parts made of metal, 22 and 23, and a middle part 24 between said parts, made of an elastic material. The locking wedge is placed in a groove 21 between two cleats 25 and 26 on the tooth, and is inserted in its place together with the tooth. A characteristic feature of the locking wedge 5 is that the edge part 23 is made with two deformable portions or buckling indications 27 and 28, one on either side of the broad side facing the connecting middle part.

If the edge part 23 is squeezed between two forces directed in opposite directions, e.g. if its end protruding in front of the tooth is given a hard blow when its inner end is in contact with the cleat 25, the edge part will be buckled out in the way shown in FIG. 4, as the force from the blow will be transmitted from one (the upper) broad side of the edge part obliquely over to its other (the lower) broad side, and the thickness of the edge part will then be the lever which causes the buckling. FIG. 4 shows in an oblique projection a securing member in the condition when it has not been buckled out. At the buckling out, the buckled out part of the securing member will be set in contact with a securing edge 29 formed in the adapter, which constitutes the outer edge of a trough 30. The locking function will thus be between this securing edge 29 and the tooth cleat 25. When it is desired to remove the tooth, a drift is placed in the through opening 31, and the securing member is buckled back. Also other securing members, which can be of types which are known in themselves, can be used to block the tooth in its position in the adapter. There are, for instance, a plurality of different types of locking wedges which are inserted through transverse openings, i.e. in the installed position they will go across the direction of installation of the tooth. Also other directions of installation of the tooth are conceivable.

When installing a cutter tooth of the type characteristic for the invention, the position of the tooth is first determined in relation to the tool, and the fitting block and the socket are thereafter fastened with consideration taken thereto with the aid of a jig which is also used for the welding of these parts into position. With the socket and the fitting block welded into position, all that remains to be done is to fasten the adapter with its draw bolt and to install the tooth.

We claim:

1. A cutter tooth system for tools for earth-moving machines comprising an adapter removably fastened on a level with the front edge of the tool, a tooth removably fastened to said adapter, and means for fastening both said adapter and said tooth in their respective places, characterized in that said adapter is made in the form of a claw which grips said front edge of said tool and is restrained in the directly opposite direction from said front edge by a pulling force applied between said adapter and a socket fixed to the tool in line behind said adapter.

2. A cutter tooth system according to claim 1, characterized in that said adapter and said socket are joined together by a bolt serving as a drawbar, said bolt being secured in and running through said adapter and said socket.

3. A cutter tooth system according to claims 1 or 2, characterized by a fitting block with an arc-shaped front edge and a rear edge welded to said front edge of said tool, so that said front edge of said fitting block constitutes a direct extension of said front edge of said tool at the place where said adapter is to be installed and said claw grips said front edge of said fitting block.

4. A cutter tooth system according to claim 3, characterized in that the part of said front edge of said fitting block which said claw of said adapter grips has a circular arc shape and that the radius of said circular arc differs from the distance between the front edge of said fitting block and the support for said pulling force in said socket.

5. A cutter tooth system according to claim 4, characterized in that the part of said circular arc-shaped front edge of said fitting block which said claw of said adapter grips has a radius which is less than said distance between said front edge of said fitting block and said support for said pulling force in said socket and that said claw of said adapter has two contact points against said front edge of said fitting block, located at a distance from each other.

6. A cutter tooth system according to claim 4, characterized in that the part of said front edge of said circular arc-shaped fitting block which said claw of said adapter grips has a radius which is greater than said distance between said front edge of said fitting block and said support for said pulling force in said socket.

7. A cutter tooth system according to claim 1, characterized in that said adapter is made in such a way as to coact with one or a plurality of guide lugs fixed to said tool thereby to absorb any transverse forces acting upon said adapter.

8. A cutter tooth system according to claim 1, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

9. A cutter tooth system according to claim 8, characterized in that said adapter is provided with a through opening on a level with said blocking edge said opening being placed in such a way that a drift inserted through said opening will force said securing edge of said securing member away from its contact with said blocking edge of said adapter.

10. A cutter tooth system according to claim 1, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

11. A cutter tooth system according to claim 1, characterized in that the adapter is forged in two halves, the parting line of which then extends along the adapter and these halves then being welded together along said parting line.

12. A cutter tooth system according to claim 2, characterized in that said adapter is made in such a way as to coact with one or a plurality of guide lugs fixed to said tool thereby to absorb any transverse forces acting upon said adapter.

13. A cutter tooth system according to claim 3, characterized in that said adapter is made in such a way as to coact with one or a plurality of guide lugs fixed to said tool thereby to absorb any transverse forces acting upon said adapter.

14. A cutter tooth system according to claim 4, characterized in that said adapter is made in such a way as to coact with one or a plurality of guide lugs fixed to said tool thereby to absorb any transverse forces acting upon said adapter.

15. A cutter tooth system according to claim 5, characterized in that said adapter is made in such a way as to coact with one or a plurality of guide lugs fixed to said tool thereby to absorb any transverse forces acting upon said adapter.

16. A cutter tooth system according to claim 6, characterized in that said adapter is made in such a way as to coact with one or a plurality of guide lugs fixed to said tool thereby to absorb any transverse forces acting upon said adapter.

17. A cutter tooth system according to claim 2, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

18. A cutter tooth system according to claim 3, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

19. A cutter tooth system according to claim 4, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

20. A cutter tooth system according to claim 5, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

21. A cutter tooth system according to claim 6, characterized in that said tooth and said adapter comprise lugs and grooves adapted to each other which, when said tooth is installed in its place, together determine its position relative to said adapter in all directions except the one opposite to that from which the installation of the tooth takes place, movement of said tooth in said opposite direction being restrained by a securing member which can be inserted from the same direction as the tooth, said securing member being located in a groove between said tooth and said adapter and comprising two edge parts made of metal and joined together by an elastic middle part, at least one of said edge parts being provided with at least one deformable portion which is buckled following installation of said tooth on said adapter to provide a securing edge which coacts with a blocking edge on said adapter facing the direction in which the tooth is installed, while the other of said edge parts contacts a further securing edge formed on said tooth facing in the opposite direction.

22. A cutter tooth system according to claim 17, characterized in that said adapter is provided with a through opening on a level with said blocking edge, said opening being placed in such a way that a drift inserted through said opening will force said securing edge of said securing member away from its contact with said blocking edge of said adapter.

23. A cutter tooth system according to claim 18, characterized in that said adapter is provided with a through opening on a level with said blocking edge, said opening being placed in such a way that a drift inserted through said opening will force said securing edge of said securing member away from its contact with said blocking edge of said adapter.

24. A cutter tooth system according to claim 19, characterized in that said adapter is provided with a through opening on a level with said blocking edge, said opening being placed in such a way that a drift inserted through said opening will force said securing edge of said securing member away from its contact with said blocking edge of said adapter.

25. A cutter tooth system according to claim 20, characterized in that said adapter is provided with a through opening on a level with said blocking edge, said opening being placed in such a way that a drift inserted through said opening will force said securing edge of said securing member away from its contact with said blocking edge of said adapter.

26. A cutter tooth system according to claim 21, characterized in that said adapter is provided with a through opening on a level with said blocking edge, said opening being placed in such a way that a drift inserted through said opening will force said securing edge of said securing member away from its contact with said blocking edge of said adapter.

27. A cutter tooth system according to claim 2, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

28. A cutter tooth system according to claim 3, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

29. A cutter tooth system according to claim 4, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

30. A cutter tooth system according to claim 5, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

31. A cutter tooth system according to claim 6, characterized in that said tooth and said adapter have lugs and grooves adapted to each other which when said tooth is installed in place together determine its position relative to said adapter in all directions except the one opposite to that from which the installation takes place, movement of said tooth in said opposite direction being restrained by a locking wedge which is inserted through an opening which extends through the adapter transverse to the direction in which the installation or removal of said tooth takes place, said locking wedge being in contact with cleats formed on said tooth and the edges of said opening.

* * * * *